United States Patent [19]

Arai et al.

[11] 4,009,038

[45] Feb. 22, 1977

[54] SILVER HALIDE COLOR PHOTOGRAPHIC MATERIALS

[75] Inventors: Atsuaki Arai; Reiichi Ohi; Minoru Yamada; Kenji Yokoo; Hiroshi Hara, all of Minami-ashigara, Japan

[73] Assignee: Fuji Photo Film Co., Ltd., Minami-ashigara, Japan

[22] Filed: May 23, 1975

[21] Appl. No.: 580,272

[30] Foreign Application Priority Data

May 23, 1974 Japan ..... 49-58271

[52] U.S. Cl. ..... 96/100; 96/56; 96/74; 96/84 UV

[51] Int. Cl.[2] ..... G03C 1/40; G03C 1/84

[58] Field of Search ..... 96/100, 84 UV, 56, 74

[56] References Cited

UNITED STATES PATENTS

| | | | |
|---|---|---|---|
| 3,533,794 | 10/1970 | Ohi et al. | 96/84 UV |
| 3,698,907 | 10/1972 | Sato et al. | 96/84 UV |
| 3,705,805 | 12/1972 | Nittel et al. | 96/84 UV |
| 3,794,493 | 2/1974 | Sobel et al. | 96/84 UV |

*Primary Examiner*—J. Travis Brown

*Attorney, Agent, or Firm*—Sughrue, Rothwell, Mion, Zinn & Macpeak

[57] ABSTRACT

A silver halide color photographic material comprising a support having thereon at least a silver halide emulsion layer containing a hydrophobic phenolic or naphtholic cyan dye forming coupler together with a 2-(2'-hydroxyphenyl)benzotriazole compound. The color photographic material provides a cyan dye image having improved moisture resistance and high fastness to heat.

13 Claims, No Drawings

SILVER HALIDE COLOR PHOTOGRAPHIC MATERIALS

BACKGROUND OF THE INVENTION

1. Field of the Invention

The present invention relates generally to a silver halide color photographic material and in particular it relates to a silver halide color photographic material providing a stabilized color image.

2. Description of the Prior Art

It is known that when a silver halide color photographic material is subjected to color development after imagewise exposure, the oxidized aromatic primary amino color developing agent reacts with a dye forming coupler in the color photographic material to form an indoaniline, indophenol, indamine, phenoxazine, azomethine, or similar dye, which results in the formation of a color image. In the known system a subtractive color process is usually used for color reproduction and yellow, magneta, and cyan color images are formed which are in complementary color relations to blue, green, and red colors, respectively. In general, an acylacetamido type coupler is used for forming a yellow dye image, a pyrazolone, cyanoacetyl, or indazolone type coupler is used for forming a magneta dye image, and a phenol or naphthol type coupler is used for forming a cyan dye image.

In such color photography, the dye forming couplers (hereinafter, designated simply "couplers") are incorporated in a color developer or in the light-sensitive photographic emulsion layers of a color photographic material to make it thus possible to cause a reaction in the photographic emulsion layers, during color development, of the couplers and the oxidation product of a color developing agent formed in the case of developing the latent images formed in the silver halide emulsion layers. In this case the couplers incorporated in the color developer are diffusible while the couplers incorporated in the photographic emulsion layers are non-diffusible.

Many phenolic or naphtholic couplers for forming cyan dye images in the above-described color photographic system are known but the cyan dye images formed by such phenolic or naphtholic couplers fade markedly when the photographs are stored for a long period of time. Color photographs are sometimes stored in such a state that they are always exposed to light (for instance, they are stored under the exposure of very intensive light or stored under a mild exposure condition as in the case of exhibitions of large-size color transparencies, color papers, color slides, etc.) or color photographs are sometimes stored in the dark for a long period of time with short light exposures (for instance, color positive cinefilms, color prints stored in albums, color slides stored in boxes, and color negative films stored in folders). The discoloration and fading of color images occurring under these latter storage conditions are caused by moisture or a small amount of chemical materials present in the surrounding atmosphere or further caused by heat and they are different from the light fading in the former case as the fading in the dark or the thermal fading. It is generally well known the occurrence of the fading in the dark or thermal fading of cyan dye images is quite severe as compared to those of yellow dye images and magneta dye images. The occurrence of this severe fading in the dark and thermal fading of the cyan dye images gives rise to obstacles in using color photographs as recording materials for semi-permanent storage. For instance, even if the extent of fading of the cyan dye images is low, the color balance of the color photograph is destroyed since the fastness of the cyan dye images differs from the fastness of the yellow dye images and the fastness of the magneta dye images and thus the level of fastness of the cyan dye images must be increased to at least the levels of the fastness of the other dye images.

Various attempts have hitherto been proposed for improving the fading in the dark and the thermal fading of cyan dye images. For instance, the fastness of the cyan dye images can be improved by processing the color photograph in a stabilization bath containing the hydantoin compound as described in U.S. Pat. No. 2,579,436; the carbohydrazide as described in U.S. Pat. No. 3,201,244; the tetramethylol ring alcohol as described in U.S. Pat. No. 2,983,607; the saccharide or the aminoacid derivative as described in U.S. Pat. Nos. 3,095,302 and 3,291,606; the cysteine as described in U.S. Pat. No. 3,201,243; the polymethylol compound as described in U.S. Pat. No. 3,473,929; the organic agent for preventing the occurrence of ferrotype fogging (e.g., mercaptans and the tautomers thereof, seleno alcohols, and heterocyclic ring compounds having an imino group) as described in Japanese Patent Publication No. 18257/1963; or the compounds as described in U.S. Pat. Nos. 3,676,136 and 3,666,468 and Japanese Patent Publication No. 47245/1972. However, these methods as shown above are still insufficient for improving the fastness of the cyan dye images and also in these methods the above-described compounds must be incorporated in the processing bath in an amount as large as about 0.5 to 20% by weight. This results in making the surfaces of color photographs thus processed sticky and gives rise to undesirable difficulties such as adhesion when they are pasted in an album.

Furthermore, an attempt has also been proposed, as described in Japanese Patent Publication No. 32728/1973, in which the compound as described in that Japanese Patent specification is incorporated in the photographic emulsion layer but the effect obtained by the method is also insufficient as is the situation with the above-described methods.

Also, since it is generally believed that the couplers remaining unreacted in the developed color photograph accelerate the fading of color images, removal of such remaining couplers has been proposed. For instance, a method in which the unreacted couplers are split into low molecular fragments during development processing and the fragments are removed by diffusion from the emulsion layers, as described in British Pat. Nos. 843,940 and 849,065, and a method in which a water-soluble coupler having a water-solubilizing group at the coupling position is incorporated in the photographic emulsion layer for protecting the dye formed by the color development from the influence of the coupler and further a dispersion of a hydrophobic solvent which does not have a solvent action for the coupler but has a strong solvent action to the dye formed from the coupler as described in U.S. Pat. No. 3,271,152, are known.

However, the former method involves complex production steps in that a processing bath for splitting the unreacted coupler into low molecular fragments is additionally required and the latter method is complex in that the water-soluble coupler and the hydrophobic solvent have to be dispersed separately in the emulsion layer. Thus, both methods are not practical methods.

Moreover, there is a method of improving the fastness of dye images by over-coating a transparent polymer film such as a polystyrene film and a polyethylene film on the surface of a color photograph after developing the material as described in U.S. Pat. No. 3,614,839 and British Pat. Nos. 1,167,519 and 1,151,771. However, the method not only requires the troublesome step of laminating the overcoat but also does not provide a sufficiently high effect of improving fading in the dark and thermal fading of the cyan dye images.

SUMMARY OF THE INVENTION

An object of this invention is, therefore, to provide a silver halide color photographic material providing a cyan dye image having improved moisture resistance and a high fastness to heat.

Another object of this invention is to provide a manner of effectively improving the fastness of color images.

A further object of this invention is to provide a silver halide color photographic material providing color images which maintain a good color balance for a long period of time when the images are stored for a long period of time after development.

These and other objects of this invention will become apparent from the following descriptions.

As the results of various investigations for attaining the above-described objects of this invention, it has now been discovered that the above objects of this invention are attained by incorporating in a silver halide emulsion layer a hydrophobic phenolic or naphtholic cyan coupler together with at least one 2-(2'-hydroxyphenyl)benzotriazole compound.

DETAILED DESCRIPTION OF THE INVENTION

The 2-(2'-hydroxyphenyl)benzotriazole compounds used in this invention have the effect of preventing the occurrence of fading in the dark and thermal fading of cyan couplers only and it should be noted that these compounds are incorporated in the silver halide emulsion layers containing cyan couplers.

The 2-(2'-hydroxyphenyl)benzotriazole compounds used in this invention are known compounds, which can be easily prepared by the methods described in U.S. Pat. Nos. 3,253,921, 3,754,919, 3,738,837, 3,533,794 and 3,705,805 and German Patent Application (OLS) 2,036,719 and hence all benzotriazole compounds having a 2-(2'-hydroxyphenyl) group are included within the scope of the compounds which can be used in this invention. For instance, a naphthotriazole having a 2-(2'-hydroxyphenyl) group is also an example of a benzotriazole compound which can be used in this invention.

Of the above-described compounds, particularly advantageous compounds are those represented by general formula (I):

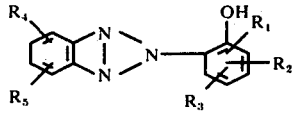

(I)

wherein $R_1$, $R_2$, $R_3$, $R_4$ and $R_5$, which may be the same or different, each represents a hydrogen atom, a halogen atom (e.g., chlorine, bromine, iodine, and fluorine atoms), a nitro group, a hydroxyl group, an alkyl group or a substituted alkyl group having one or more of an alkoxy group, a hydroxy group, a halogen atom, an acyl group, an aryloxy group, an amido group, a carbamoyl group, a sulfamoyl group, etc., as substituents (e.g., methyl, ethyl, n-propyl, iso-propyl, aminopropyl, n-butyl, sec-butyl, tert-butyl, chloromethyl, chlorobutyl, hydroxymethyl, n-amyl, iso-amyl, hexyl, octyl, nonyl, stearylamidobutyl, decyl, dodecyl, pentadecyl, hexadecyl, cyclohexyl, benzyl, phenylethyl, methoxycarbamoylmethyl, and phenylpropyl groups), an alkenyl group (e.g., having 2 to 18 carbon atoms such as vinyl, allyl, methallyl dodecenyl, tridecenyl, tetradecenyl, and octadecenyl groups), an aryl group (e.g., phenyl, naphthyl, 4-methylphenyl, 4-ethoxyphenyl, 2-hexoxyphenyl, and 3-hexoxyphenyl groups), an alkoxy group (e.g., methoxy, ethoxy, propoxy, butoxy, chlorobutoxy, decoxy, 2,4-ditert-amylphenoxyethyl, pentadecoxy, and octadecoxy groups), an acyloxy group (e.g., carbomethoxy, carbobutoxy, carbohexoxy, and carbopentadecoxy groups), an aryloxy group (e.g., phenoxy, 4-methylphenoxy, 2-propylphenoxy, and 3-amylphenoxy groups), an alkylthio group (e.g., methylthio, ethylthio, tert-butylthio, tert-octylthio, and benzylthio groups), an arylthio group (e.g., phenylthio, methylphenylthio, ethylphenylthio, methoxyphenylthio, ethoxyphenylthio, and naphthylthio groups), a mono- or di-alkylamino group (e.g., N-ethylamino, N-tert-octylamino, N,N-diethylamino, and N,N-di-tert-butylamino groups) or a 5- or 6-membered heterocyclic group containing an oxygen or nitrogen atom (e.g., piperidino, morpholino, pyrrolidino, imidazolino, indolino, phthalimido, succinimido, hydantoinyl, oxazolidinyl, and piperazino groups); and $R_4$ and $R_5$ can combine to form a 5- or 6-membered carbon atom containing ring (e.g., a methine chain).

In general formula (I) shown above, it is desired that the total number of carbon atoms of the substituents represented by $R_1$ to $R_5$ range from 5 to 36 and also it is preferred that the alkyl group has 1 to 18 carbon atoms.

Of the compounds represented by general formula (I), the even more advantageous compounds are the compounds represented by general formula (II):

Coupler N:2-[α-(2',4'-Di-tert-amylphenoxy)-butyramido]-4,6-dichloro-5-methylphenol Coupler O:1-Hydroxy-4-chloro-N-[γ-(2',4'-di-tert-amylphenoxy)propyl]-2-naphthamide

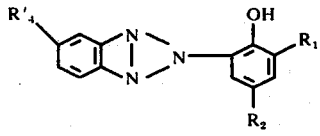

(II)

wherein $R_1$ and $R_2$ have the same meaning as in general formula (I) and $R'_4$ represents a hydrogen atom, a halogen atom as described for the general formula (I), or the same alkyl, alkoxy, aryl, or aryloxy groups as in general formula (I). It is particularly preferred for $R'_4$ in general formula (II) to be a halogen atom.

Specific examples of compounds represented by general formula (I) are illustrated below although the compounds used in this invention are not to be construed as being limited to these compounds.

(1) 2-(2'-Hydroxy-5'-tert-butylphenyl)benzotriazole (2) 2-(2'-Hydroxy-3',5'-di-tert-butylphenyl)benzotriazole
(3) 2-(2'-Hydroxy-3'-tert-butyl-5'-methylphenyl)-5-chlorobenzotriazole
(4) 2-(2'-Hydroxy-3',5'-di-tert-butylphenyl)-5-chlorobenzotriazole
(5) 2-(2'-Hydroxy-5'-isooctylphenyl)benzotriazole
(6) 2-(2'-Hydroxy-5'-n-octylphenyl)benzotriazole
(7) 2-(2'-Hydroxy-3',5'-di-t-amylphenyl)benzotriazole
(8) 2-(2'-Hydroxy-5'-dodecylphenyl)benzotriazole
(9) 2-(2'-Hydroxy-5'-hexadecylphenyl)benzotriazole
(10) 2-(2'-Hydroxy-3'-t-amyl-5'-benzenephenyl)benzotriazole
(11) 2-(2'-Hydroxy-3'-t-amyl-5'-phenylphenyl)benzotriazole
(12) 5-Methyl-2-(2'-hydroxy-5'-isooctylphenyl)benzotriazole
(13) 5-Octyl-2-(2'-hydroxy-5'-isooctylphenyl)benzotriazole
(14) 5-Carbobutoxy-2-(2'-hydroxy-3'-n-butyl-5'-t-amylphenyl)benzotriazole
(15) 5-Chloro-2-(2'-hydroxy-3'-n-amyl-5'-phenylphenyl)benzotriazole
(16) 5-Methoxy-2-(2'-hydroxy-3',5'-di-t-amylphenyl)benzotriazole
(17) 5-Nitro-2-(2'-hydroxy-3'-n-octyl-5'-methoxyphenyl)benzotriazole
(18) 5-Chloro-2-(2'-hydroxy-3'-t-butyl-5'-cyclohexylphenyl)benzotriazole
(19) 5-Methyl-2-(2'-hydroxy-3'-chloro-5'-n-octylphenyl)benzotriazole
(20) 5-Phenyl-2-(2'-hydroxy-3',5'-di-t-amylphenyl)benzotriazole
(21) 5-Methyl-2-(2'-hydroxy-3'-t-amyl-5'-phenoxyphenyl)benzotriazole
(22) 2-(2'-Hydroxy-3'-tert-butyl-5'-sec-butylphenyl)-5-chlorobenzotriazole
(23) 2-(2'-Hydroxy-3'-sec-butyl-5'-tert-butylphenyl)-5-clorobenzotriazole
(24) 2-(2'-Hydroxy-5'-chlorophenyl)-5-chlorobenzotriazole
(25) 2-(2'-Hydroxy-5'-phenylphenyl)-5-chlorobenzotriazole
(26) 2-(2'-Hydroxy-5'-cyclohexylphenyl)-5-chlorobenzotriazole
(27) 2-(2'-Hydroxy-4',5'-dichlorophenyl)benzotriazole
(28) 2-(2'-Hydroxy-3',5'-dichlorophenyl)-5-methoxybenzotriazole
(29) 2-(2'-Hydroxy-4',5'-dichlorophenyl)-5-methylbenzotriazole
(30) 2-(2'-Hydroxyphenyl)-5,6-diisopropoxybenzotriazole
(31) 2-(2'-Hydroxy-5'-methylphenyl)-5,6-diisopropoxybenzotriazole
(32) 2-(2'-Hydroxyphenyl)-5-methyl-6-dodecoxybenzotriazole
(33) 2-(2'-Hydroxyphenyl)-5-methyl-6-isononyloxybenzotriazole
(34) 2-(2'-Hydroxyphenyl)-5,6-di-n-butoxybenzotriazole
(35) 2-(2'-Hydroxy-3'-sec-butyl-5'-tert-butylphenyl)-5-methoxybenzotriazole
(36) 2-(2'-Hydroxy-3',5'-di-tert-butyl-5'-methylphenyl)benzotriazole
(37) 2-(2'-Hydroxy-3',5'-di-sec-butylphenyl)-5-chlorobenzotriazole
(38) 2-(2'-Hydroxy-5'-methylphenyl)-2H-naphthotriazole, and
(39) 2-(2'-Hydroxy-5'-ethylphenyl)-2H-(5-chloronaphthotriazole).

The hydrophobic coupler used in this invention means a non-diffusible coupler which is substantially water-insoluble and contains no water solubilizing groups such as $-SO_3H$, $-SO_3Na$-, -COOH, etc., and is soluble in an organic solvent used in the photographic system in which couplers are incorporated in the photographic emulsion layers of a color photographic material. That is to say, as will be explained below, the hydrophobic coupler used in this invention must be soluble in an organic solvent for dispersion by emulsification of the coupler and also be non-diffusible because the coupler must be fixed in the emulsion layer in which the coupler is incorporated. Thus, a group having a hydrophobic group of 8 to 32 carbon atoms is introduced into the coupler. Such a residue is called "a ballast group" and can be bonded to the coupler skeleton directly or through an amino bond, an ether bond, a carbonamido bond, a sulfonamido bond, a ureido bond, an ester bond, an imido bond, a carbamoyl bond, a sulfamoyl bond, etc. Specific examples of suitable ballast groups are as follows:

I. Alkyl groups and alkenyl groups:

For instance, $-Ch_2-CH-(C_2H_5)_2$, $-C_{12}H_{25}$, $-C_{16}H_{33}$, and $C_{17}H_{33}$.

II. Alkoxyalkyl groups:

For instance, $-(CH_2)_3-O-(CH_2)_7CH_3$, and $$-(CH_2)_3OCH_2-\underset{\underset{C_2H_5}{|}}{CH}-(CH_2)_8-CH_3$$

as described in Japanese Patent Publication No. 27563/1964.

III. Alkylaryl groups:

For instance,

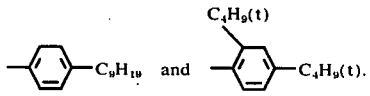

IV. Alkylaryloxyalkyl groups:

For instance,

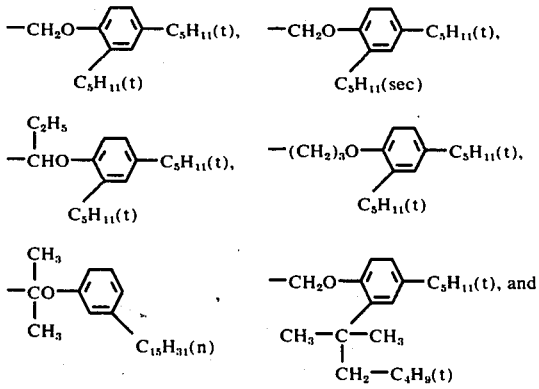

-continued

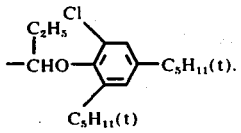

V. Acylamidoalkyl groups:
For instance,

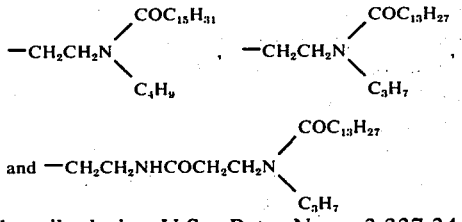

as described in U.S. Pat. Nos. 3,337,344 and 3,418,129.

VI. Alkyloxyaryl groups and aryloxyaryl groups:
For instance,

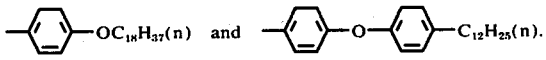

VII. Alkyl groups substituted with an ester group:
For instance,

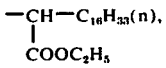

and $-CH_2-CH_2-COOC_{12}H_{25}(n)$.

VIII. Alkyl groups substituted with an aryl group or a heterocyclic ring:
For instance,

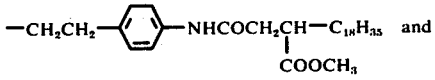

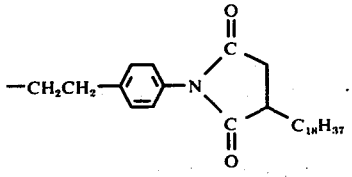

Examples of hydrophobic cyan couplers which can be advantageously used in the present invention are hydrophobic phenolic or naphtholic couplers described in, for instance, Japanese Patent Publication No. 27563/1964; British Patent No. 562,205; U.S. Patent Nos. 2,369,929, 2,474,293, 2,698,794, 2,895,826, 3,560,212, 3,386,301, 2,434,272, 2,706,684, 3,583,971, 3,582,322, 2,908,573, 3,476,563, 3,619,196, 2,423,730, 2,801,171, 3,046,129, 3,516,831, 3,311,476, 3,253,294, 3,458,315, 3,227,550, 3,419,390, 3,034,892, 2,772,162, 2,322,027, 3,779,763, 3,632,347, 3,652,286, and 3,591,383; and German Patent Application (OLS) No. 2,207,468, which are herein incorporated by reference.

The phenolic and naphtholic cyan couplers used in this invention include the compounds represented by general formulae (III) and (IV):

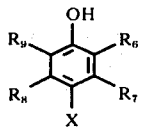

(III)

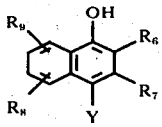

(IV)

wherein $R_6$, $R_7$, $R_8$, and $R_9$, which may be the same or different, each represents a hydrogen atom, an alkyl group (e.g., having 1 to 32 carbon atoms including unsubstituted alkyl groups such as methyl, ethyl, butyl, t-butyl, hexyl, octyl, dodecyl, pentadecyl, octadecyl, etc. groups and substituted alkyl groups containing one or more halogen atoms and nitro, hydroxy, carboxy, amino (e.g., amino, N-alkylamino, N,N-di-alkylamino, N-arylamino, N-alkyl-N-arylamino, etc.), carboxyester (e.g., carbomethoxy, carboethoxy, carbophenoxy, etc.), sulfo, sulfo ester (e.g., methoxysulfonyl, phenoxysulfonyl, etc.), amido (e.g., acetamido, [α-(2,4-di-t-amylphenoxy)acetamido]benzamido, 3,5-dicarboxybenzamido, ethylsulfonamido, etc.), carbamyl (e.g., N-methylcarbamyl, etc.), sulfamyl (e.g., N-propylsulfamyl, etc.), alkoxy (e.g., methoxy, butoxy, etc.), aryloxy (e.g., phenoxy, naphthoxy, etc.) etc. groups as substituents), an aryl group (including unsubstituted aryl groups (such as phenyl, naphthyl, etc.) and substituted aryl groups containing one or more of alkyl, alkoxy, sulfonyl, sulfamoyl, amido, etc. groups as substituents (e.g., tolyl, p-methylsulfonylphenyl, N-t-butylsulfamoylphenyl, m-acetamidophenyl, p-octadecoxyphenyl, etc.), a heterocyclic ring (e.g., as described hereinbefore for $R_1$ to $R_5$), an amino group (e.g., amino, alkylamino, arylamino, and heterocyclic amimo grousp (such as those containing the same alkyl, aryl and heterocyclic moieties as hereinabove described for the alkyl group, the aryl group and the heterocyclic group)), a carbonamido group (e.g., alkylcarbonamide, arylcarbonamido, and heterocyclic carbonamido groups (such as those containing the same alkyl, aryl and heterocyclic moieties as hereinabove described for the alkyl group, the aryl group and the heterocyclic group)), a sulfonamido group (e.g., alkylsulfonamido, arylsulfonamido, and heterocyclic sulfonamido groups (such as those containing the same alkyl, aryl and heterocyclic moieties as hereinabove described for the alkyl group, the aryl group and the heterocyclic group)), a sulfamoyl group (e.g., alkylsulfamoyl, arylsulfamoyl, and heterocyclic sulfamoyl groups (such as those containing the same alkyl, aryl and heterocyclic moieties as hereinabove described for the alkyl group, the aryl group and the heterocyclic group)), a carbamoyl group (e.g., alkylcarbamoyl, arylcarbamoyl, and heterocyclic carbamoyl groups (such as those containing the same alkyl, aryl and heterocyclic moieties as hereinabove described for the alkyl group, the aryl group and the heterocyclic group)), an alkoxy group (e.g., having 1 to 32 carbon atoms, preferably 1 to 22 carbon atoms such as methoxy, ethoxy, butoxy, octyloxy, dodecyloxy, pentadecyloxy, octadecyloxy, etc. groups), or an aryloxy group (e.g., phenoxy, alkylsulfonylphenoxy, N-alkylsulfamoylphenoxy, acetamidophenoxy, naphthoxy, methoxyphenoxy, sulfamoyl-phenoxy, etc. groups); and $R_6$ to $R_9$ can be advantageously substituted with a ballast group (e.g., as described hereinbefore); and X and Y each represents a hydrogen atom, a coupling releasable group (e.g., a chlorine atom, a bromine atom, an iodine atom and a fluorine atom), a thiocyano group, an acyloxy group (e.g., alkoyloxy, aroyloxy, and heterocycloyloxy groups (such as acetoxy, 2,4-di-t-amylphenoxyacetoxy, benzoyloxy, tri-fluoromethylcarbonyloxy, benzofuranylcarbonyloxy, oxazolylcarbonyloxy, 4-ethoxyphenylcarbonyloxy, etc. groups)), a sulfonamido group (such as methanesulfonamido, benzenesulfonamido, phenylsulfonamido, p-tolylsulfonamido, p-nitro-phenylsulfonamido, 1-naphthylsulfonamido, etc. groups), a cyclic imido group (e.g., maleimido, succinimido, 1,2-dicarboxyimido, and phthalimido groups), an -OCONHR group (where R is an alkyl group or an aryl group), an -N=C=S group, an $-OSO_2R$ group (where R is as hereinbefore described), an aryloxy group (e.g., phenoxy, naphthoxy, etc.), a heterocyclic oxy group (e.g., 1-phenyl-5-tetrazolyloxy, 2-benzimidazolyloxy, 4-benzoxazolyloxy, 2-pyridyloxy, etc.), an arylazo group (e.g., phenylazo, naphthylazo, 4-methoxyphenylazo, etc.), an alkylthio group (e.g., ethylthio, t-butylthio, etc.), an arylthio group (e.g., phenylthio, p-tolylthio, 2-nitrophenylthio, etc.), a heterocyclicthio group (e.g., phenyl-5-tetrazolylthio, 2-benzothiazoylthio, etc.), an -OCOOR group (where R is as hereinbefore described, e.g., benzyloxycarbonyloxy, ethoxycarbonyloxy, etc.), or an -NHCOR group (where R is as hereinbefore described). Phenol type cyan couplers of the general formula (III) substituted with a halogen atom, or an unsubstituted or substituted acylamino group in the $R_6$ or $R_9$ position are preferred. Naphthol type cyan couplers of the general formula (IV) unsubstituted or substituted with a carbamoyl group in the $R_6$ position are preferred.

Specific examples of hydrophobic cyan couplers of the general formulas (III) and (IV) described above are shown below:

Cyan Coupler 1

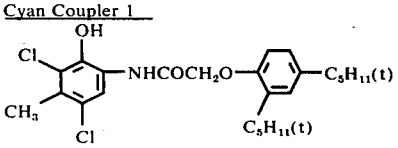

Cyan Coupler 2

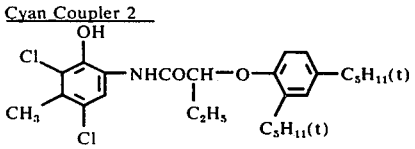

Cyan Coupler 3

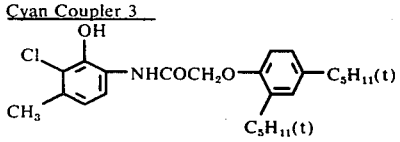

Cyan Coupler 4

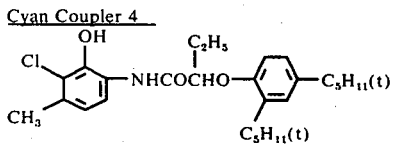

Cyan Coupler 5

-continued

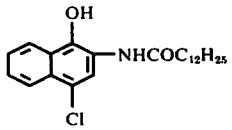

Cyan Coupler 6

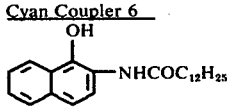

Cyan Coupler 7

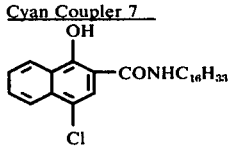

Cyan Coupler 8

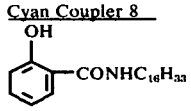

Cyan Coupler 9

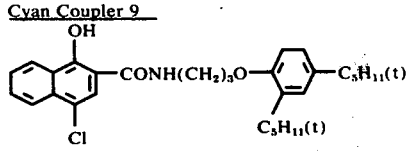

Cyan Coupler 10

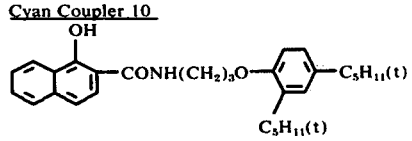

Cyan Coupler 11

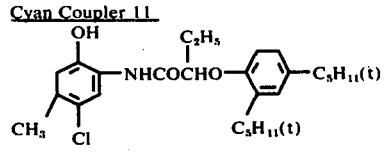

Cyan Coupler 12

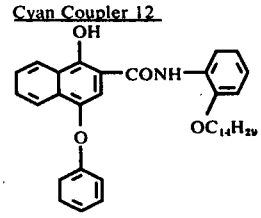

Cyan Coupler 13

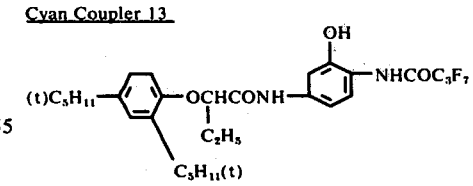

Cyan Coupler 14

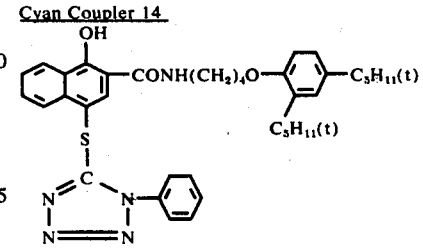

Cyan Coupler 15

-continued

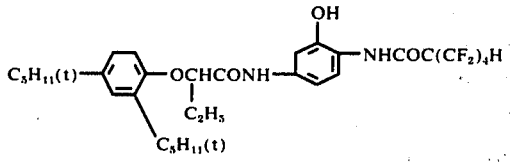

Cyan Coupler 16

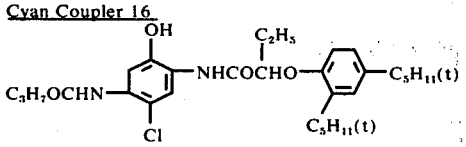

Cyan Coupler 17

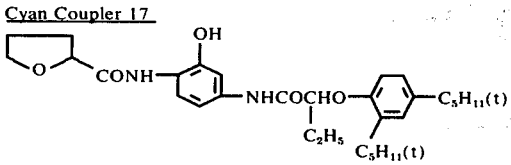

Cyan Coupler 18

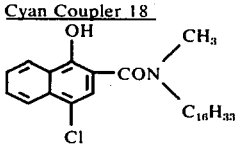

Cyan Coupler 19

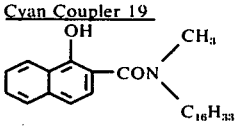

Cyan Coupler 20

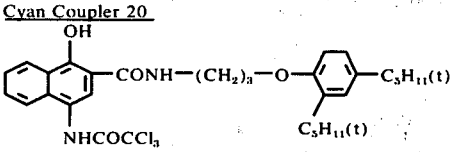

Cyan Coupler 21

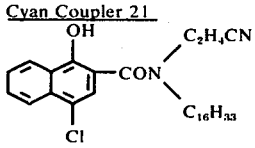

Cyan Coupler 22

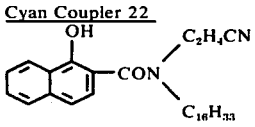

The hydrophobic cyan couplers used in the color photographic materials of this invention can be selected from wide range of compounds and are not to be construed as being limited to the compounds represented by above general formulae (III) and (IV). However, in general, phenolic cyan couplers are advantageously used as cyan couplers used in this invention. In the present invention, the hydrophobic cyan couplers can be used individually but two or more phenolic cyan couplers or naphtholic cyan couplers can be used and further the combination of one or more phenolic cyan couplers and one or more naphtholic cyan couplers can be also used.

In the color photographic material of this invention, preferably the amount of the 2-(2'-hydroxyphenyl)-benzotriazole compound incorporated in the silver halide emulsion layer ranges from about 0.01 to 3 parts by weight, particularly 0.05 to 1.5 parts by weight, per part by weight of the hydrophobic cyan coupler incorporated in the same silver halide emulsion layer.

The 2-(2-hydroxyphenyl)benzotriazole compound and/or the hydrophobic cyan coupler used in this invention is advantageously mixed in a solvent dispersion by dissolving the compound or coupler in an organic solvent which has a boiling point higher than about 170° C and which is immiscible with water, a lowboiling organic solvent, or a water-soluble organic solvent or by dissolving the compound or coupler in a high-boiling and water-immiscible organic solvent and/or a low-boiling organic solvent and/or water-soluble organic solvent.

The 2-(2'-hydroxyphenyl)benzotriazole compound used in this invention can be dispersed in a photographic emulsion separately from the hydrophobic cyan coupler or can be dispersed therein together with the cyan coupler but they are preferably dissolved in the above-described solvent or solvent mixture and then dispersed in the photographic emulsion.

In this case, the high-boiling organic solvent immiscible with water as described in U.S. Pat. No. 2,322,027 can be used as the solvent in this invention. Preferred examples of solvents are di-n-butyl phthalate, benzyl phthalate, triphenyl phosphate, tri-o-cresyl phosphate, diphenyl-p-t-butylphenyl phosphate, monophenyl-di-p-t-butylphenyl phosphate, diphenylmono-o-chlorophenyl phosphate, monophenyl-di-o-chlorophenyl phosphate, tri-p-t-butylphenyl phosphate, triphenyl phosphate, di-p-t-butylphenyl mono-(5-t-butyl-2-phenylphenyl) phosphate, dioctyl phthalate, dibutyl sebacate, acetyltributyl citrate, tri-t-octyl melllitate, n-nonylphenol, dioctylbutyl phosphate, N,N-diethyl laurylamide, 3-pentadecylphenyl ethyl ether, and 2,5-di-sec-amylphenyl butyl ether.

Examples of low-boiling (lower than about 170° C) organic solvents or water-soluble organic solvents used together with the above-described high-boiling organic solvents or in place of the high-boiling organic solvents in this invention are described in, e.g., U.S. Pat. Nos. 2,801,171, 2,801,170 and 2,949,360. Specific examples of organic solvents are as follows:

1. Low-boiling organic solvents which are substantially insoluble in water, such as methyl acetate, ethyl acetate, propyl acetate, butyl acetate, isopropyl acetate, ethyl propionate, sec-butyl alcohol, nitromethane, nitroethane, carbon tetrachloride, and chloroform;

2. Water-soluble organic solvents such as methyl isobutyl ketone, β-ethoxyethyl acetate, β-methoxyethyl acetate, tetrahydrofurfuryl adipate, Carbitol acetate (or diethylene glycol monoacetate), methoxytriglycol acetate, methyl Cellosolve acetate, acetonyl acetone, diacetone alcohol, butyl Carbitol, butyl Cellosolve, methyl Carbitol, methylacetone, methanol, ethanol, acetonitrile, dimethylformamide, and dioxane.

The amount of water in the solvent solution must be sufficiently low so that the water does not adversely influence the solubilities of the benzotriazole compound and the hydrophobic cyan coupler used in this invention. For instance, U.S. Pat. No. 2,801,171 describes the removal of the low-boiling or water-soluble solvent from the dispersion by air-drying the dispersion after cooling or by continuously washing the dispersion with water.

It is known that the 2-(2'-hydroxyphenyl)benzotriazole compounds represented by general formula (I) have excellent properties as ultraviolet absorbents and are used in photographic materials. However, the present invention is clearly distinguished from these known techniques in the purpose, method, and advantage of using the benzotriazole compounds. That is to say, a feature of the present invention is the improvement of the fastness of cyan dye images formed in color photographic materials to heat and moisture by incorporating the above-described hydrophobic phenolic and/or naphtholic cyan couplers and the 2-(2'-hydroxyphenyl)benzotriazole compounds in a same photographic emulsion layer and this feature of this invention has never been known prior to this invention.

Namely, the use of the benzotriazole compounds represented by general formula (I) in the protective layers, interlayers, silver halide emulsion layers, and backing layers of color photographic materials as ultraviolet absorbents are disclosed in U.S. Pat. Nos. 3,253,921, 3,533,794, 3,754,919, 3,705,805, 3,738,837, and 3,698,907 and German Patent Application (OLS) No. 2,036,719 and of the above patents the incorporation of benzotriazole compounds in photographic emulsion layers is described in U.S. Pat. Nos. 3,738,837, 3,794,493, and 3,533,794. However, the former two disclosures describe only blue-sensitive silver halide emulsion layers cotnaining yellow couplers and the latter disclosure describes only red-sensitive silver halide emulsion layers containing water-soluble cyan couplers.

A cyan coupler is generally present in a red-sensitive silver halide emulsion layer and in the present invention the most typical embodiment of the layer containing the triazole compound and the hydrophobic cyan coupler is a red-sensitive silver halide emulsion layer. However, it should be emphasized that if the triazole compound and the cyan coupler are not present in the same emulsion layer and the cyan coupler is not hydrophobic, the cyan dye image formed in the emulsion layer does not have improved fastness to moisture and heat. On considering this point, it will be understood that a triazole compound, in particular the compound represented by general formula (I) provides a far higher action with respect to a hydrophobic cyan coupler than to a water-soluble cyan coupler. The above difference in activity will become apparent from the examples shown below.

Furthermore, when the color photographic material of this invention has a green-sensitive silver halide emulsion layer and a blue-sensitive silver halide emulsion layer together with the red-sensitive silver halide emulsion layer containing the triazole compound and the hydrophobic cyan coupler at the opposite side thereof to the side of incident light on displaying or projection of the finished color tansparency, the light fastness of the magenta dye image and the yellow dye image formed in the green- and blue-sensitive silver halide emulsion layers is also improved by the ultraviolet absorbing effect of the triazole compound. That is to say, the effect or advantage of the triazole compound as described in the above-described patents is also maintained in the color photographic material of this invention.

When a triazole compund is used in an ultraviolet absorption layer as an ultraviolet absorbent for improving the light fastness of color images, an important factor is for the triazole compound to have excellent solubility. However, when it is difficult to obtain an ultraviolet absorbent having excellent solubility and an ultraviolet absorbent having a deficient solubility is incorporated in an ultraviolet absorbing filter layer in a sufficient amount for improving the light fastness of the color images, the ultraviolet absorbent deposits to reduce its effect as an ultraviolet absorbent. On the other hand, in the present invention, the triazole compound having an excellent property as an ultraviolet absorbent is used in a red-sensitive silver halide emulsion layer as an emulsified dispersion thereof and the hydrophobic cyan coupler and hence the amount of a triazole compound as an ultraviolet absorbent in the ultraviolet absorbent in the ultraviolet abosrbing filter layer can be reduced. Therefore, in the present invention, there is also the advantage that a coating composition for the ultraviolet absorbing filter layer can be easily prepared and further the light fastness of the color images can be also improved in spite of using an ultraviolet absorbing filter layer containing a reduced amount of the triazole compound as an ultraviolet absorbent.

The red-sensitive silver haldie emulsion layer containing the triazole compound represented by general formula (I) and the hydrophobic cyan coupler used in this invention can additionally contain a development inhibitor releasing type coupler. Specific examples of such development inhibitor releasing type couplers are:

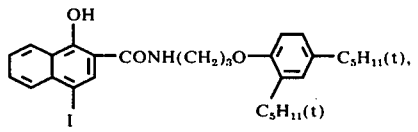

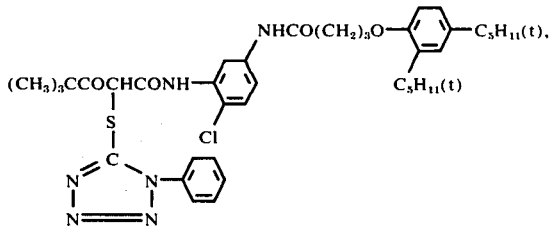

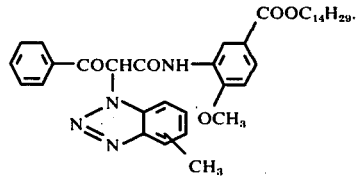

Couplers of this type are disclosed in U.S. Pat. Nos. 3,227,554, 3,148,062, 3,617,291, 3,622,328, 3,253,924, 3,297,445, 3,379,529, 3,705,201, and 3,639,417.

Furthermore, the red-sensitive silver halide emulsion layer containing the above-described two components in this invention can be separated into a low sensitive layer and a high sensitive layer according to the purpose.

The amount of the hydrophobic cyan coupler incorporated in the emulsion layer is generally about $5 \times 10^{-5}$ to $5 \times 10^{-3}$ mol/m$^2$, preferably $3 \times 10^{-4}$ to $2 \times 10^{-3}$ mol/m$^2$. When a development inhibitor releasing coupler is used together with the hydrophobic cyan coupler in the same emulsion layer, preferably, the amount of the development inhibitor releasing coupler is about 5 to 30 mol % of the cyan coupler.

Also, when the present invention is applied to color negative films, the red-sensitive silver halide emulsion layer containing the triazole compound and the hydrophobic cyan coupler can contain the colored couplers as described in, for instance, U.S. Pat. Nos. 2,725,292, 3,459,552, 3,658,545, 3,667,956, 3,496,986, and 3,642,485 in an amount of about 5 to 20 mol % of the cyan coupler. Specific examples of such colored couplers are as follows:

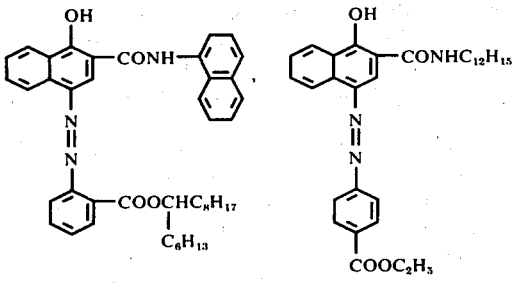

The hydrophilic silver halide emulsion layers suitable for the purpose of this invention can contain gelatin, colloidal albumin, the cellulose derivatives or the synthetic resins as described in U.S. Pat. Nos. 2,286,215 and 2,327,808, the water-soluble ethanolamine cellulose acetate as described in U.S. Pat. No. 2,322,085, the polyvinyl alcohol containing a urethanecarboxylic acid group as described in U.S. Pat. No. 2,768,154, the copolymer of vinyl alcohol containing a cyanoacetyl group such as a copolymer of vinyl alcohol and vinyl cyanoacetate as described in U.S. Pat. No. 2,808,331, a protein polymer, or a polymer as described in U.S. Pat. No. 2,852,382.

A silver halide emulsion is generally prepared by mixing an aqueous solution of a water-soluble silver salt such as silver nitrate and an aqueous solution of a halide such as potassium bromide in the presence of an aqueous solution of a polymer such as gelatin. In this case, silver chloride, silver bromide, or a mixed silver halide such as silver chlorobromide, silver iodobromide and silver chloroiodobromide can be used as the silver halide.

These silver halide grains can be prepared using conventional methods. It is, of course, advantageous to employe a so-called single jet or double jet method, a control jet method, etc., in this case. Also, two or more silver halide photographic emulsions separately prepared can be mixed.

These photographic silver halide emulsions can be prepared in any known manner, such as an ammonia method, a neutralization method, an acid method, etc., as described in, e.g., in C. E. K. Mees and T. H. James, *The Theory of the Photographic Process*, Macmillan, New York (1966) and Grafikides, *Photographic Chemistry*, Fauntain Press Co.

Various compounds for preventing a reduction in sensitivity and a formation of fog during the preparation of the color photographic materials or during the storage or processing of the color photographic materials can be added to the above-described silver halide photographic emulsions. Examples of such compounds are heterocyclic compounds such as 4-hydroxy-6-methyl-1,3,3a,7-tetraazaindene, 3-methylbenzothiazole, 1-phenyl-5-mercaptotetrazole, mercury-containing compounds, mercapto compounds, and metal salts, for instance, as disclosed in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,728,663, 2,728,664, 2,728,665, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668, 3,622,339, and British Pat. Nos. 869,428, 403,789, 1,173,609, and 1,200,188.

The above-described silver halide emulsion can also be chemically sensitized. Examples of suitable chemical sensitizers which can be used for this purpose are the gold compounds such as chloroaurates and gold trichloride as described in U.S. Pat. Nos. 2,399,083, 2,540,085, 2,597,856, and 2,597,915, the salts of noble metals such as platinum, palladium, iridium, rhodium, and ruthenium as described in U.S. Pat. Nos. 2,448,060, 2,540,086, 2,566,245, 2,566,263, 2,598,079, the sulfur compounds which can form silver sulfide by reaction with silver salts as described in U.S. Pat. Nos. 1,574,944, 2,410,689, 3,189,458, and 3,501,313, and the stannous salts, amines and other reductive materials as described in U.S. Pat. Nos. 2,487,850, 2,518,698, 2,521,925, 2,521,926, 2,694,637, 2,983,610, and 3,201,254.

The photographic silver halide emulsions used in this invention can be further subjected to a spectral sensitization or a super dye sensitization using cyanine dyes such as cyanine, merocyanine and carbocyanine individually or as a combination thereof or further with a combination of the cyanine dyes and styryl dyes. These dye sensitization techniques are well known and are described in, for instance, Japanese Patent Publication No. 10773/1968; U.S. Pat. Nos. 3,511,664, 3,522,052, 3,527,641, 3,615,613, 3,615,632, 3,617,295, 3,635,721, 3,694,217; and British Pat. Nos. 1,137,580 and 1,216,203. The dyes or combinations can be selected according the wavelength region to be sensitized and the sensitivity desired and the purpose and the use of the photographic materials.

Furthermore, in the present invention the formation of stains and color mixing can be prevented by incorporating in the photographic silver halide emulsions the hydroquinone derivatives as described in U.S. Pat. Nos. 2,336,327, 2,360,290, 2,384,658, 2,403,721, 2,418,613, 2,675,314, 2,701,197, 2,704,713, 2,728,659, 2,732,300, 2,735,765, 3,457,079, 2,418,613, 3,700,455, 2,710,801, and 2,816,028. These hydroquinone derivatives can be used individually or as a combination thereof.

The silver halide photographic emulsions used in this invention can be hardened using conventional techniques and examples of suitable hardening agents are aldehyde compounds such as formaldehyde and glutaraldehyde; ketone compounds such as diacetylcyclopentanedione; bis(2-chloroethylurea); 2-hydroxy-4,6-dichloro-1,3,5-triazine; reactive halogen compounds as described in U.S. Pat. Nos. 3,288,775 and 2,732,303 and British Pat. Nos. 974,723 and 1,167,207; divinylsulfone; 5-acetyl-1,3-diacryloylhexahydro-1,3,5-triazine; reactive olefin compounds as described in U.S. Pat. Nos. 3,635,718 and 3,232,763 and British Pat. No. 994,869; N-hydroxymethylphthalimide; the N-methylol compounds as described in U.S. Pat. Nos. 2,732,316 and 2,586,168; halo carboxyaldehydes such as mucochloric acid; dioxane derivatives such as dihydroxydioxane, dichlorodioxane, etc.; and inorganic hardening agents such as chrome alum and zirconium sulfate.

Furthermore, precursors such as alkali metal bisulfite-aldehyde addition products, methylol derivatives of hydantoin, primary aliphatic nitro alcohols, etc., can be used in place of the above-described compounds.

The benzotriazole compound represented by general formula (I) is sometimes incorporated in other emulsion layers such as a filter layer, a protective layer, a backing layer, and other silver halide emulsions layers than the silver halide emulsion layer containing the cyan coupler in addition to being also incorporated in the cyan coupler-containing layer. Moreover, the silver halide emulsion layer containing the 2-(2'-hydroxyphenyl)benzotriazole compound and the hydrophobic cyan coupler, in particular, a red-sensitive silver halide emulsion layer containing the above components can further contain an ultraviolet absorbent as described in U.S. Pat. Nos. 2,685,512, 2,739,888, 2,719,086, 2,739,971, 2,747,996, 2,784,087, 3,253,921, 3,533,794, 3,004,896, 3,159,646, and 3,214,436.

Also, surface active agents, individually or as a mixture thereof, can be additionally added to the silver halide photographic emulsions. The surface active agents are used as a coating aid as well as for improving the dispersibility, for sensitization, for improving the photographic characteristics, for prevention of the generation of static charges, and for preventing adhesion of the color photographic materials. Examples of suitable surface active agents which can be used for these purposes are natural surface active agents such as saponin, etc.; nonionic surface active agents such as alkylene oxide series surface active agents, glycerin series surface active agents, glycidol series surface active agents, etc.; cationic surface active agents such as higher alkyl amines, quaternary ammonium salts, heterocyclic compounds (e.g., pyridine, etc.), phosphoniums, and sulfoniums; anionic surface active agents having an acid group such as a carboxylic acid group, a sulfonic acid group, a phosphoric acid group, a sulfuric acid ester group, a phosphoric acid group, etc.; and amphoteric surface active agents such as aminoacids, aminosulfonic acids, and sulfuric esters or phosphoric acid esters of amino alcohols.

Some typical examples of surface active agents which can be used in this invention are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974; German Patent Application (OLS) No. 1,942,665; British Pat. Nos. 1,077,317 and 1,198,450; Ryohei Oda, *Synthesis and Application of Surface Active Agents*, Maki Shoten, Tokyo (1964); A. W. Perry, *Surface Active Agents*, Interscience Publications Incorporated (1958); and J. P. Sisley, *Encyclopedia of Surface Active Agents*, Vol. 2, Chemical Publishing Co., (1964).

When the present invention is applied to multilayer color photographic materials, open chain type diketomethylene compounds are generally used as yellow couplers. Examples of such yellow couplers are described in, for instance, U.S. Pat. Nos. 3,341,331, 2,778,658, 2,908,573, 3,227,550, 3,253,924, 3,384,657, 2,875,057, 3,551,155, 3,265,506, 3,582,322, 3,725,072, 3,369,895, 3,408,194, 3,227,155, 3,447,928, and 3,415,652; German Patent Application (OLS) Nos. 1,547,868, 2,162,899, 2,057,941, 2,213,461, 2,219,917, 2,261,361, and 2,263,875, etc.

As magenta couplers, 5-pyrazolone compounds are mainly used but indazolone compounds and cyanoacryl compounds are also used. Examples of these compounds are described in, for instance, U.S. Pat. Nos. 2,439,098, 3,006,759, 3,152,896, 3,214,437, 3,408,194, 3,227,554, 2,600,788, 3,062,653, 3,558,319, 2,801,171, 2,908,573, 3,252,924, 3,227,550, 3,432,521, 3,582,322, 3,615,506, 3,519,429, 3,311,476, 3,419,391, and 2,983,608; British Patent No. 956,261; Japanese Patent Application Nos. 21,454/1973, 114,446/1972, 114,445/1972, 114,446/1972, 114,445/1972, 108,798/1973, 56,050/1973, and 45,971/1973; German Patent Application (OLS) No. 1,810,464; and Japanese Patent Publication No. 2016/1969.

Two or more kinds of the above-described couplers can be incorporated in one silver halide emulsion layer for satisfying certain characteristics desired for the color photographic material and further a coupler can be incorporated in two or more silver halide emulsion layers.

These photographic emulsions are coated on a substantially planar substance which does not undergo severe dimensional deformation during processing, for instance, a rigid support such as a glass sheet, a metallic sheet, or ceramic support and a flexible support.

Typical examples of flexible supports are cellulose nitrate films, cellulose acetate films, cellulose acetate butyrate films, cellulose acetate propionate films, polystyrene films, polyethylene terephthalate films, polycarbonate films, laminates of the above-described polymers, thin glass films, papers, etc. Also, baryta-coated papers, papers coated or laminated thereon of a polymer of an $\alpha$-olefin, in particular a polymer of an $\alpha$-olefin having 2 to 10 carbon atoms, such as polyethylene, polypropylene, and an ethylene-butene copolymer, and synthetic resin films of which the surfaces are matted to improve the adhesion to other polymers and also improve the printability thereof as described in Japanese Patent Publication No. 19068/1972 can also be used as the support.

In the present invention, transparent supports and opaque supports can be employed according to the end-use purpose of the color photographic materials as illustrated above. The opaque supports used in this invention can be intrinsically opaque ones such as papers or can be transparent films opacified by the incorporation of a dye or a pigment such as titanium oxide, synthetic resin films of which the surfaces have been treated in the manner as described in Japanese Patent Publication No. 19,068/1972, and further papers or synthetic resin films which have been rendered completely light intercepting by the incorporation of carbon black, etc., into the film.

If the adhesion between the support and the photographic emulsion layer is insufficient, a subbing layer having good adhesion to both the support and the emulsion layer is formed on the surface of the support. Furthermore, for further improving the adhesion of the support, the surface of the support can be subjected to a pre-treatment such as corona discharging, ultraviolet radiation, flame treatment, etc.

The coating compositions for the photographic layers of the color photographic material can be coated by a suitable coating method such as dip coating, air knife coating, curtain coating, and extrusion coating using, for instance, the hopper described in U.S. Pat. No. 2,681,294. A suitable coating amount of silver halide ranges from about $5 \times 10^{-5}$ to $2 \times 10^{-1}$ mol of silver halide per square meter, preferably $1 \times 10^{-3}$ to $5 \times 10^{-2}$ mol of silver halide per square meter.

If desired, two or more layers can be coated simultaneously using the method as described in U.S. Pat. Nos. 2,761,791, 3,508,947, 2,941,898, and 3,526,528.

The color photographic materials of this invention include various coupler-containing color photographic materials such as color negative films, color positive films, color reversal films, and color papers.

The color photographic materials of this invention can be processed using a conventional photographic processing. Specific examples of processing methods will be explained below.

A preferred color developer is an aqueous alkaline solution containing a color developing agent. Typical examples of color developing agents are primary aromatic amino dye-forming developing agents such as, for instance, phenylenediamines (e.g., N,N-diethyl-p-phenylenediamine, N-ethyl-N-hydroxyethyl-p-phenylenediamine, 4-(N-ethyl-N-hydroxyethyl)amino-2-methylaniline, 4-(N-ethyl-N-β-methanesulfonamidoethyl)amino-2-methylaniline, 4-(N,N-diethyl)amino-2-methylaniline, 4-(N-ethyl-N-methoxyethyl)amino-2-methylaniline, and the sulfates, hydrochlorides, and sulfites thereof) as disclosed, for example, in C. E. K. Mees and T. H. James, *The Theory of the Photographic Process*, 3rd Ed., pages 294 ~ 295, Macmillan Co., New York, (1966) and U.S. Pat. Nos. 2,592,364 and 2,193,015, etc.

The color developer can additionally contain conventionally used additives such as, for instance, an alkali metal sulfite, an alkali metal carbonate, an alkali metal bisulfite, bromide, iodide, benzyl alcohol, etc.

Color development is usually carried out at temperatures from about 15° C to about 60° C, preferably from 20° C to 45° C.

After the color development, the color photographic material of this invention is bleached in a conventional manner. The bleaching can be carried out simultaneously with fixing or separately from fixing. If desired, a fixing agent can be added to the bleach solution to provide a blix bath.

Many compounds can be used as the bleaching agent. Examples of bleaching agents are ferricyanates, bichromates, water-soluble cobalt(III) salts, water-soluble copper(II) salts, water-soluble quinones, nitrosophenols, compounds of multivalent metals such as iron(III), cobalt(III), and copper(II), and, in particular, the complex salts of these multivalent metal cations and organic acids, such as the metal complex salts of ethylenediamine tetraacetic acid, nitrilotriacetic acid, iminodiacetic acid, N-hydroxyethyl ethylenediamine triacetic acid, malonic acid, tartaric acid, malic acid, diglycolic acid, dithioglycolic acid, etc., and 2,6-dipicolic acid-copper complex salt. Other examples of bleaching agents are peracids such as alkyl peracids, persulfates, permanganates, hydrogen peroxide, etc., and hypochlorites. These agents can be used individually or as a suitable combination thereof.

The bleach solution can additionally contain the bleach accelerators as described in U.S. Pat. Nos. 3,042,520 and 3,241,966 and Japanese Patent Publication Nos. 8506/1970 and 8836/1970.

The invention will be further explained more specifically by reference to the following examples but the invention is not to be construed as being limited to these examples. Unless otherwise indicated, all parts, percents, ratios and the like are by weight.

EXAMPLE 1

Samples A, B, C, and D were prepared by coating each of the following 4 kinds of coating compositions on a paper having a polyethylene layer laminated on the surface of the paper.

Coupler L: 1-Hydroxy-4-sulfo-2-N-dodecylnaphthamide (water-soluble coupler).

Coupler M: 1-Hydroxy-4-chloro-2-N-dodecylnaphthamide (hydrophobic coupler).

Dispersion of Coupler L: 135 ml of an aqueous solution containing 6.82 g of Coupler L and 9.6 ml of a 1N aqueous sodium hydroxide solution.

Emulsified Dispersion of Coupler M: An emulsified dispersion prepared by dissolving 6.11 g of Coupler M in a mixture of 6 ml of dibutyl phthalate and 10 ml of ethyl acetate and then dispersing the solution in 60 ml of an aqueous solution containing 6 g of gelatin and 0.3 g of sodium dodecylbenzenesulfonate at 60° C by means of a colloid mill.

Emulsified Dispersion of the Triazole compound of this Invention: An emulsified dispersion prepared by dissolving a mixture of 0.72 g of Compound 3, 1.68 g of Compound 4, and 0.24 g of Compound 1 in a mixture of 2 ml of dibutyl phthalate and 4 ml of ethyl acetate and then dispersing the solution in 30 ml of an aqueous solution containing 3 g of gelatin and 0.15 g of sodium dodecylbenzenesulfonate at 60° C by means of a colloid mill.

Silver Halide Emulsion Composition: An aqueous emulsion containing $4.7 \times 10^{-2}$ mols of silver halide (silver bromide 55 mol % and silver chloride 45 mol %) and 8 g of gelatin per 100 g of the emulsion.

Coating Composition for Sample A: A mixture of the above-described coupler dispersion containing Coupler L and 100 g of the above-described silver halide emulsion.

Coating Composition for Sample B: A mixture of the above-described coupler dispersion containing Coupler L, the above-described emulsified dispersion of the benzotriazole compound of this invention, and 100 g of the above-described silver halide emulsion.

Coating Composition for Sample C: A mixture of the above-described coupler dispersion containing Coupler M and 100 g of the above-described silver halide emulsion.

Coating Composition for Sample D: A mixture of the above-described coupler dispersion containing Coupler M, the above-described emulsified dispersion of the benzotriazole compound of this invention, and 100 g of the above-described silver halide emulsion.

A mixture of the above-described coupler dispersion containing Coupler M, the above-described emulsified dispersion of the benzotriazole compound of this invention, and 100 g of the above-described silver halide emulsion.

After adjusting each of the coating compositions to a pH of 7.0 and adding thereto 5 ml of a 3% acetone solution of triethylene phosphoramide, the coating composition was coated on the support.

The coated amounts of the coupler and silver in each of Samples A, B, C, and D were $1.09 \times 10^{-3}$ mol/m² and $3.27 \times 10^{-3}$ mol/m², respectively.

Each of the samples was exposed through an optical step wedge and processed according to following processing steps.

| Processing Step | Temperature | Time |
|---|---|---|
| Color Development | 30° C | 6 min. |
| Stop | " | 2 " |
| Wash | " | 2 " |
| Blix | " | 90 sec. |
| Wash | " | 2 min. |
| Stabilization | " | 2 " |
| Drying | | |

The compositions of the processing solutions used in the above steps were as follows:

| | |
|---|---|
| Color Developer: | |
| Benzyl Alcohol | 12 ml |
| Diethylene Glycol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfate | 2.0 g |
| Di-sodium Ethylenediamine Tetraacetate Di-hydrate | 2.0 g |
| 4-Amino-3-methyl-N-ethyl-N-(β-methanesulfonamidoethyl)aniline Sesquisulfate (monohydrate) | 5.0 g |
| Water to make | 1 l |
| Stop Solution: | |
| Sodium Thiosulfate | 10 g |
| Ammonium Thiosulfate (70% aq. soln.) | 30 ml |
| Sodium Acetate | 5 g |
| Acetic Acid | 30 ml |
| Potassium Alum | 15 g |
| Water to make | 1 l |
| Blix Solution: | |
| Ferric Sulfate | 2.0 g |
| Di-sodium Ethylenediamine Tetraacetate (dihydrate) | 36 g |
| Sodium Carbonate (monohydrate) | 17 g |
| Sodium Sulfite | 5 g |
| Ammonium Thiosulfate (70% aq. soln.) | 100 ml |
| Boric Acid | 5 g |
| pH adjusted to 6.8 and water added to make | 1 l. |
| Stabilization Solution: | |
| Boric Acid | 5 g |
| Sodium Citrate | 5 g |
| Sodium Metaborate (tetrahydrate) | 3 g |
| Potassium Alum | 15 g |
| Water to make | 1 l |

After storing each of the color papers thus processed in the dark for 20 days at a temperature of 60° C and a relative humidity of 75% RH or for 7 days at 80° C under a substantially dry atmosphere, the density reduction of the cyan dye image to the initial density thereof (D = 2.0, D = 1.0, and D = 0.5) was measured. The results obtained are shown in Table 1.

TABLE 1

| Sample | (A)* | | | (B)* | | |
|---|---|---|---|---|---|---|
| | D=0.5 | D=1.0 | D=2.0 | D=0.5 | D=1.0 | D=2.0 |
| A | 22 | 21 | 18 | 12 | 11 | 12 |
| B | 21 | 22 | 16 | 12 | 12 | 11 |
| C | 23 | 22 | 17 | 13 | 13 | 10 |
| D | 14 | 15 | 9 | 9 | 7 | 4 |

(A): Stored for 20 days at 60° C and 75% RH
(B): Stored for 7 days at 80° C

In Table 1, the fastness to moisture and heat was higher as the density reduction (%) was lower.

When the samples were stored for 20 days at 60° C and 75% RH, the moisture and heat fastness of Sample A was substantially the same as that of Sample B and the density reduction (%) of the samples was quite high (about 20%). That is to say, when the water-soluble cyan coupler and the triazole compound were incorporated in the same emulsion layer, the fastness to heat and moisture of the cyan dye image formed was not improved.

On the other hand, as clear from the results of Samples C and D, the density reduction of the cyan dye image when the hydrophobic coupler only was present in the silver halide emulsion layer was almost the same as that of the case of incorporating the water-soluble cyan coupler in the silver halide emulsion layer but the density reduction was about 50% lower when the hydrophobic cyan coupler and the triazole compound were incorporated in the same silver halide emulsion layer. That is to say, the moisture and heat fastness of the cyan dye image was increased to about twice the original value by the present invention.

When the samples were stored for 7 days at 80° C under a substantially dry atmosphere, the effect of this invention was clearly obtained as can be understood from the results shown in Table 1.

EXAMPLE 2

A color print paper (Sample E) was prepared by coating on a polyethylene-laminated paper support a blue-sensitive silver halide emulsion containing α-pivaloyl-α-(5′,5′-dimethyl-2′,4′-dioxo-3′-oxazolidinyl)-2-chloro-5-[α-(2′,4′-di-tert-amylphenoxy)-butyramido]acetanilide at a coverage of $1.18 \times 10^{-3}$ mol/m² of the coupler and $3.53 \times 10^{-3}$ mol/m² of silver as a first layer of a thickness of 3 microns, an aqueous gelatin solution containing t-octyl hydroquinone at a coverage of 0.03 g/m² of the hydroquinone as an interlayer (second layer) of a thickness of 1.5 microns, a green-sensitive silver halide emulsion containing 10 parts by weight of 1-(2′,4′,6′-trichlorophenyl)-3-(2′-chloro-5′-tetradecanoylanilino)-5-pyrazolone, 4 parts by weight of 2,2,4-trimethyl-6-hydroxy-7-t-octyl cumarone, and 1 part by weight of 2,5-di-tert-octyl hydroquinone at a coverage of $5.89 \times 10^{-4}$ mol/m² of the coupler and $4.12 \times 10^{-2}$ of silver as a third layer of a thickness of 3.1 microns, an aqueous gelatin solution containing 1.5 parts by weight of 2-(2′-hydroxy-3′-tert-butyl-5′-methylphenyl)-5-chlorobenzotriazole, 2 parts by weight of 2-(2′-hydroxy-3′-tert-butylphenyl)benzotriazole, and 0.35 part by weight of 2,5-di-tert-octyl hydroquinone at a coverage of 0.058 g/m² of the benzotriazole compounds and 0.058 g/m² of the hydroquinone compound as an interlayer (fourth layer) of a thickness of 2.3 microns, a coating composition prepared by dissolving 7.7 g of 2-[α-(2′,4′-di-tert-amylphenoxy)butyramido]-4,6-dichloro-5-methylphenol, 2 g of 2-(2′-hydroxy-3′-tert-butyl-5′-methylphenyl)-5-chlorobenzotriazole, and 2 g of 2-(2′-hydroxy-3′-tert-butylphenyl)benzotriazole in a mixture of 8 ml of dibutyl phthalate and 13 ml of ethyl acetate by heating, dispersing by emulsification the solution thus prepared in 80 ml of a hot aqueous solution containing 8 g of gelatin and 0.4 g of sodium dodecylbenzenesulfonate by means of a colloid mill, and adding the emulsified dispersion to 100 g of a red-sensitive silver halide emulsion containing $4.7 \times 10^{-2}$ mols of silver halide (silver chloride 45 mol% and silver bromide 55 mol%) and 9 g of gelatin after adjusting the pH thereof to 6.5 and adding further thereto 5 ml of an acetone solution of 3% triethylene phosphoramide as a hardening agent at a coverage of $0.98 \times 10^{-3}$ mol/m² of the coupler, $2.94 \times 10^{-3}$ mol/m² of silver, and 0.22 g/m² of the benzotriazole compounds as a fifth layer of a thickness of 2.5 microns, and finally a gelatin protective layer as a sixth layer.

Also, another color print paper (Sample F) was prepared in the same manner as in the case of preparing Sample E except that the benzotriazole compounds were not incorporated in the fifth layer but were incorporated in the fourth layer at a coverage of 0.80 g/m² of the benzotriazole compounds.

The color print papers thus prepared were exposed stepwise to blue, green, and red lights respectively and developed as in Example 1 to form a yellow dye image, a magenta dye image, and a cyan dye image in each case.

The samples thus developed were exposed to each of the following three test conditions, respectively, and the density reductions (%) of the color images after testing to the initial densities (D = 2.0, D = 1.0, and D = 0.5) of the color images before testing were measured. The results obtained are shown in Table 2.

1. Fading in the Dark: Stored for 20 days at 60° C and 75%RH
2. Heat Fading: Stored for 7 days at 80° C under substantially dry atmospheric condition.
3. Light Fading: Exposed to a fluorescent lamp at an illuminance of about 30,000 lux for 4 weeks.

TABLE 2

| Sample | Color Image | Dark Fading D=0.5 | Dark Fading D=1.0 | Dark Fading D=2.0 | Heat Fading D=0.5 | Heat Fading D=1.0 | Heat Fading D=2.0 | Light Fading D=0.5 | Light Fading D=1.0 | Light Fading D=2.0 |
|---|---|---|---|---|---|---|---|---|---|---|
| E | Yellow | 4 | 3 | 1 | 2 | 0 | 0 | 12 | 15 | 14 |
| | Magenta | 5 | 5 | 2 | 11 | 8 | 4 | 31 | 27 | 27 |
| | Cyan | 29 | 22 | 21 | 38 | 48 | 42 | 21 | 16 | 7 |
| F | Yellow | 5 | 2 | 2 | 2 | 1 | 0 | 14 | 14 | 13 |
| | Magenta | 5 | 4 | 1 | 10 | 9 | 5 | 32 | 27 | 26 |
| | Cyan | 12 | 11 | 8 | 25 | 33 | 33 | 16 | 13 | 5 |

As shown by the results in the above table, the fading in the dark of the cyan dye image was quite low in Sample E as compared with Sample F, which shows clearly the fading prevention effect of the benzotriazole compounds of this invention.

Also, the total amount of the benzotriazole compounds coated on the blue-sensitive emulsion layer and the green-sensitive emulsion layer were same in Sample E and Sample F and from the results shown above that the light fastness of the yellow dye image and the magenta dye image was almost the same in both samples, in the case of utilizing the ultraviolet absorbing effect of the benzotriazole compounds, they may be incorporated in the fourth layer or the fifth layer. Since the emulsified dispersion of the benzotriazole compounds is unstable, it is advantageous to use the compounds as in Sample E, in which the emulsified dispersion can be kept stably for a long period of time.

EXAMPLE 3

In the same manner as in the case of Samples C and D in Example 1, an emulsified dispersion having the following composition was prepared. The dispersion was then mixed with a silver halide photographic emulsion containing $5.6 \times 10^{-2}$ mols of silver halide (silver chloride 50 mol% and silver bromide 50 mol%) and 8 g of gelatin per 100 g of the emulsion and after controlling the pH to 7.0 and adding thereto the hardening agent as in Example 1, the mixture was coated on a cellulose triacetate film support at a coverage of $1.34 \times 10^{-3}$ mol/m² of the coupler and $4.02 \times 10^{-3}$ mol/m² of silver.

Coupler N: 2-[α-(2',4'-Di-tert-amylphenoxy) buthramido]-4,6-dichloro-5-methlphenol Coupler O: 1-Hydroxy-4-chloro-N-[γ-(2',4'-di-tert-amyl-phenoxy) propyl]-2-naphthamide

| Sample | Coupler and Amount | Compound of the Invention and Amount | High-Boiling Solvent (amount) |
|---|---|---|---|
| 1 | N(10 g) | — | Dibutyl phthalate (10 ml) |
| 2 | N(10 g) | ( 2) 2.5 g | " (10 ml) |
| | " | ( 3) 1.5 g | " (10 ml) |
| 3 | N(10 g) | (15) 1.5 g | " (10 ml) |
| | " | (13) 1.5 g | " (10 ml) |
| 4 | N(10 g) | (22) 2 g | " (10 ml) |
| | " | (23) 3 g | " (10 ml) |
| 5 | N(10 g) | (22) 2 g | Tri-tert-octyl myristate (10 ml) |
| | N(10 g) | (23) 3 g | " (10 ml) |
| 6 | O(10 g) | — | Dibutyl phthalate (10 ml) |
| 7 | O(10 g) | (32) 1.5 g | " (10 ml) |
| | " | (37) 1.5 g | " (10 ml) |
| 8 | O(10 g) | (22) 1.5 g | " (10 ml) |
| | " | (23) 3.5 g | " (10 ml) |
| | " | ( 4) 0.5 g | " (10 ml) |

The films thus prepared were exposed stepwise and then subjected to the following development procedures.

| Processing Step | Temperature | Time |
|---|---|---|
| Color Development | 27° C | 5 min 20 sec |
| Wash | " | 15 sec |
| First Fix | " | 1 min |
| Wash | " | 40 sec |
| Bleach | " | 3 min |
| Wash | " | 1 min |
| Second Fix | " | 2 min |
| Wash | " | 5 min |

The compositions of the processing solutions used in the above processings were as follows:

| | |
|---|---|
| Color Developer: | |
| Water | 800 ml |
| Sodium Hexametaphosphate | 2.0 g |
| Sodium Sulfite (anhydrous) | 4.0 g |
| 4-(N,N-Diethyl)amino-2-methylaniline Hydrochloride | 3.0 g |
| Sodium Carbonate (monohydrate) | 25.0 g |
| Potassium Bromide | 2.0 g |
| Water to make | 1 l |
| First Fixing Solution and Second Fixing Solution: | |
| Water | 600 ml |
| Sodium Thiosulfate (pentahydrate) | 240 g |
| Sodium Sulfite (anhydrous) | 15.0 g |
| Glacial Acetic Acid | 12.0 g |
| Boric Acid | 6.0 g |
| Potassium Alum | 15.0 g |
| Water to make | 1 l |
| Bleach Solution: | |
| Water | 800 ml |
| Potassium Bromide | 20.0 g |
| Potassium Bichromate | 5.0 g |
| Potassium Alum | 40.0 g |
| Sodium Acetate (trihydrate) | 3.0 g |
| Glacial Acetic Acid | 10.0 g |
| Water to make | 1 l |

The film samples thus developed were subjected to the fading test as in Example 1 and the density reduction (%) was measured. The results obtained are shown in Table 3.

TABLE 3

| Sample | (A)* D=0.5 | (A)* D=1.0 | (A)* D=2.0 | (B)* D=0.5 | (B)* D=1.0 | (B)* D=2.0 |
|---|---|---|---|---|---|---|
| 1 | 13 | 17 | 19 | 36 | 48 | 50 |
| 2** | 11 | 10 | 8 | 28 | 33 | 35 |
| 3** | 9 | 9 | 8 | 25 | 30 | 32 |
| 4** | 10 | 7 | 7 | 24 | 22 | 18 |
| 5** | 10 | 9 | 7 | 18 | 23 | 19 |
| 6 | 23 | 22 | 17 | 13 | 13 | 11 |
| 7** | 11 | 10 | 9 | 10 | 10 | 8 |
| 8** | 9 | 8 | 7 | 9 | 10 | 9 |

*As described in Table 1.
**Invention Samples

From the above results, it can be understood that Samples 2 5 and 7 – 8 of this invention showed high fastness of color images as compared with Comparison Samples 1 and 6.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least a silver halide emulsion layer containing a hydrophobic phenolic or naphtholic cyan dye-forming coupler and at least one 2-(2′-hydroxyphenyl)-benzotriazole compound.

2. The silver halide color photographic material of claim 1, in which said 2-(2′-hydroxyphenyl)benzotriazole compound is represented by general formula (I):

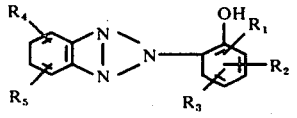

(I)

wherein $R_1$, $R_2$, $R_3$, $R_4$, and $R_5$, which can be the same or different, each represents a hydrogen atom, a halogen atom, a nitro group, a hydroxyl group, an alkyl group, an alkenyl group, an alkoxy group, an acyloxy group, an aryl group, an aryloxy group, an alkylthio group, an arylthio group, a monoalkylamino group, a dialkylamino group, or a heterocyclic group, and $R_4$ and $R_5$ may combine to form a 5-membered or 6-membered carbon atom containing ring.

3. The silver halide color photographic material of claim 2, in which said 2-(2′-hydroxyphenyl)benzotriazole compound is represented by general formula (II):

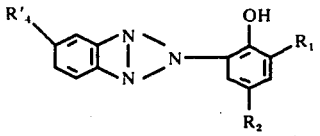

(II)

wherein $R_1$ and $R_2$ each represents a hydrogen atom, a halogen atom, a nitro group, a hydroxyl group, an alkyl group, an alkenyl group, an alkoxy group, an acyloxy group, an aryl group, an aryloxy group, an alkylthio group, an arylthio group, a monoalkylamino group, a dialkylamino group, or a heterocyclic group and $R'_4$ represents a halogen atom, an alkyl group, an alkoxy group, an aryl group, or an aryloxy group.

4. The silver halide color photographic material of claim 1, in which said hydrophobic phenolic or naphtholic cyan coupler is represented by the following general formulae (III) or (IV):

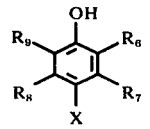

(III)

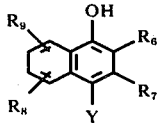

(IV)

wherein $R_6$, $R_7$, $R_8$ and $R_9$, which can be the same or different, each represents a hydrogen atom, a halogen atom, a cyano group, an alkyl group, an alkoxy group, an aryl group, an aryloxy group, a heterocyclic group, an amino group, a carbonamido group, a sulfonamido group, a sulfamoyl group, or a carbamoyl group; and at least one of said $R_6$ to $R_9$ is substituted with a ballast group; and X and Y each represents a hydrogen atom or a coupling releasable group.

5. The silver halide color photographic material of claim 1, in which said silver halide emulsion layer containing the 2-(2′-hydroxyphenyl)benzotriazole compound and the hydrophobic phenolic or naphtholic cyan coupler is a red-sensitive emulsion layer.

6. The silver halide color photographic material of claim 1, in which said color photographic material comprises a support having thereon at least three silver halide emulsion layers sensitive to different wavelength regions and said three silver halide emulsion layers are a blue-sensitive silver halide emulsion layer containing a yellow coupler, a green-sensitive silver halide emulsion layer containing a magenta coupler, and a red-sensitive silver halide emulsion layer containing the 2-(2′-hydroxyphenyl)benzotriazole compound and the hydrophobic phenolic or naphtholic cyan coupler.

7. The silver halide color photographic material of claim 1, in which said 2-(2′-hydroxyphenyl)benzotriazole compound is present in the silver halide emulsion layer as an emulsified dispersion thereof.

8. The silver halide color photographic material of claim 6, in which said color photographic material further includes a filter layer containing the 2-(2′-hydroxyphenyl)-benzotriazole compound.

9. The silver halide color photographic material of claim 2, in which said silver halide emulsion layer contains at least two compounds represented by general formula (I).

10. The silver halide color photographic material of claim 1, in which the amount of the 2-(2′-hydroxyphenyl)-benzotriazole compound in said silver halide emulsion layer is about 0.01 to 3 parts by weight per part by weight of the hydrophobic phenolic or npahtholic cyan coupler in said silver halide emulsion layer.

11. The silver halide color photographic material of claim 2, in which at least one of $R_4$ and $R_5$ in general formula (I) is a halogen atom.

12. The silver halide color photographic material of claim 4, in which said hydrophobic phenolic cyan coupler is a 2-acylamino-5-methyl-6-chlorophenolic compound.

13. In a silver halide photographic material comprising a support having thereon at least one silver halide emulsion layer containing a phenolic or naphtholic cyan dye-forming coupler and at least one 2-(2'-hydroxyphenyl)-benzotriazole compound, the improvement which comprises said cyan coupler being hydrophobic and being incorporated in said silver halide emulsion layer with said benzotriazole compound.

* * * * *